US005274425A

United States Patent [19]

Fukumoto et al.

[11] Patent Number: 5,274,425

[45] Date of Patent: Dec. 28, 1993

[54] TONER SEALING MATERIAL

[75] Inventors: Yasuhiro Fukumoto; Yasutoyo Kotani; Chiaki Kato; Masaya Nishi, all of Osaka, Japan

[73] Assignee: Sumitomo Electric Industries Ltd., Osaka, Japan

[21] Appl. No.: 736,345

[22] Filed: Jul. 26, 1991

[30] Foreign Application Priority Data

Jul. 30, 1990 [JP] Japan ..... 2-202682

[51] Int. Cl.[5] ..... G03G 21/00

[52] U.S. Cl. ..... 355/215; 118/656; 355/259

[58] Field of Search ..... 355/215, 245, 251, 259, 355/260, 261; 118/647, 651, 653, 656, 661

[56] References Cited

U.S. PATENT DOCUMENTS 4,108,112 8/1978 Hudson ..... 118/655
4,398,494 8/1983 Alheid ..... 118/410
4,449,810 5/1984 Ikesue et al. ..... 118/658 X
4,640,600 2/1987 Hirabayashi et al. ..... 219/470 X

FOREIGN PATENT DOCUMENTS 0192770 8/1987 Japan ..... 355/215

*Primary Examiner*—Leo P. Picard
*Assistant Examiner*—Christopher Horgan
*Attorney, Agent, or Firm*—Sughrue, Mion, Zinn Macpeak & Seas

[57] ABSTRACT

A toner sealing material for use in a toner cartridge of an electrophotographic image formation apparatus is disclosed. The toner sealing material comprises an elastic layer which is in contact with the cartridge via an adhesive layer and a tetrafluoroethylene resin porous layer having a thickness of at least 0.2 mm which is laminated on the elastic layer via an adhesive layer and is in contact with a developing roller fixed to the cartridge. With the sealing material, a toner can be prevented from leaking from a toner cartridge for an extended period of time.

4 Claims, 1 Drawing Sheet

FIG. 1
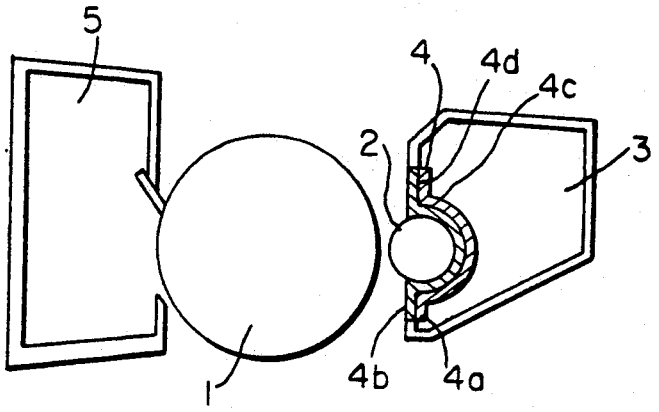
FIG. 2
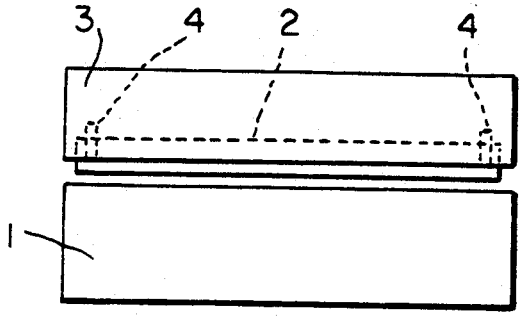
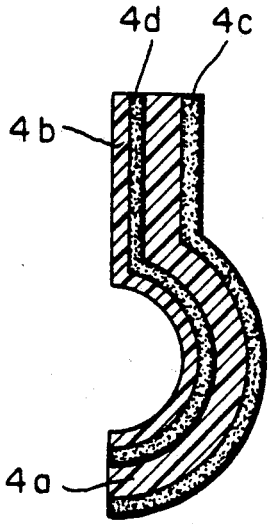
FIG. 3

TONER SEALING MATERIAL

FIELD OF THE INVENTION

This invention relates to a toner sealing material for preventing toner leakage in electrophotographic copying machines or image forming apparatus utilizing electrophotography such as a printer and a facsimile.

BACKGROUND OF THE INVENTION

Functions of electrophotographic image forming apparatus are to uniformly charge a photosensitive drum, imagewise expose the photosensitive drum to an original pattern light to make the drum discharge on the exposed area to form an electrostatic latent image, adhere a toner to the latent image, and electrostatically transfer the adhered toner to copying paper.

The image forming apparatus has a developing roller at the opening of a toner cartridge so as to face to a photosensitive drum.

In conventional apparatus, the parts of a toner cartridge where the developing roller are held are covered with felt.

On the other hand, known sealing materials which are used in contact with a photosensitive drum to prevent toner leakage from the drum include an elastic material laminated with a 20 to 200 μm thick heat-shrunk fluorine resin film as proposed in JP-A-U-60-16154 (the term "JP-A-U" as used herein means an "unexamined published Japanese utility model application") and an elastic material laminated with a 30 μm thick heat-shrunk fluorine resin film as proposed in JP-A-U-60-173960.

When felt is used at the roller holding parts of a toner cartridge, the felt is battered through long-term use to make a gap between the developing roller and the holding parts. As a result, a toner is leaked therethrough or passes through the felt fibers to contaminate the inside of the apparatus or to stain copies, causing poor image quality.

Further, when the sealing material disclosed in JP-A-U-60-16154 or JP-A-U-60-173960 is applied to the roller holding parts of a toner cartridge, there sometimes results the following disadvantage.

The surface of bearing parts of a developing roller sometimes has unevenness in the axial direction due to the surface finishing. In particular, if there is a protrusion, the elastic material undergoes great deformation via the fluorine resin film in contact with such a protrusion to cause stress concentration. As a result, the fluorine resin film is broken or worn out or does not fit the developing roller. This being the case, a gap is formed between the sealing material and the roller, and the toner leaks therethrough to contaminate the inside of the apparatus or to stain copies.

SUMMARY OF THE INVENTION

An object of the present invention is to provide a toner sealing material for use in electrophotographic image formation apparatus, with which a toner can be prevented from leaking from a toner cartridge for an extended period of time.

Other objects and effects of the present invention will be apparent from the following description.

The present invention relates to a toner sealing material for preventing toner leakage through bearing parts of a developing roller fixed to a toner cartridge which faces to a photosensitive drum, the toner sealing material comprising an elastic layer which is in contact with the cartridge via an adhesive layer and a tetrafluoroethylene resin porous layer having a thickness of at least 0.2 mm which is laminated on the elastic layer via an adhesive layer and is in contact with the developing roller.

BRIEF DESCRIPTION OF THE DRAWINGS

FIG. 1 illustrates a schematic view of an electrophotographic image formation apparatus in which the toner sealing material of the present invention is used.

FIG. 2 is a schematic view taken from above of he photosensitive drum and the developing roller of FIG. 1.

FIG. 3 is a schematic view of the layers contained in the tetrafluroethylene resin porous layer recited in claim 1.

PREFERRED EMBODIMENT OF THE INVENTION

FIG. 1 shows one embodiment of the present invention, in which numeral 1 indicates a photosensitive drum, 2 indicates a developing roller, 3 indicates a toner cartridge, 4 indicates a toner sealing material according to the present invention, 4*a* indicates an elastic layer, 4*b* indicates a tetrafluoroethylene resin porous layer, 4*c* indicates an adhesive layer, 4*d* indicates a another adhesive layer, and 5 indicates a toner recovery box.

In FIG. 3, layers 4*a* to 4*d* of FIG. 1 are further illustrated. More specifically, in FIG. 3, 4*a* represents the elastic layer, 4*b* represents the tetralfuoroethylene resin porous layer, and 4*c* and 4*d* both represent the adhesive layers.

The material of elastic layer 4*a* is not particularly limited in kind as long as it does not loose its elasticity during long-term use. Examples of the materials used for the elastic layer include rubbers, e.g., polyurethane rubber, chloroprene rubber and silicone rubber, and foamed bodies thereof. Preferred of them is chloroprene rubber having a degree of foaming of from 60 to 85%. The hardness of the elastic layer is not particularly limited but is preferably from 1° to 30° as measured by Asker C type hardness meter.

The thickness of the elastic layer is not particularly limited but is generally from 2.5 to 4.0 mm, and preferably from 2.5 to 3.0 mm.

Sealing material 4 is adhered to toner cartridge 3 via adhesive layer 4*c*, and elastic layer 4*a* and porous layer 4*b* are adhered together via adhesive layer 4*d*. Means for the adhesion are not particularly limited, and double coated adhesive tape may be used, or adhesion may be effected by heat fusion.

According to the present invention, the tetrafluoroethylene resin porous layer having a thickness of at least 0.2 mm undergoes plastic deformation in agreement with the surface unevenness of the developing roller so that it keeps a close contact with the roller to perform a satisfactory sealing function. Since the tetrafluoroethylene resin has low frictional resistance, the torque for revolution of the roller can be reduced, and stability in revolution can be assured.

Since the elastic layer is made of such a material that does not loose elasticity even under pressure for a long time (e.g., chloroprene rubber), it retains its function of pushing the porous resin layer onto the developing roller for an extended period of time. Thus, the sealing material of the invention eliminates the above-described disadvantages associated with use of felt, such as leakage of toner through a gap formed by a batter of felt or passing of toner through fibers of felt.

Even where the developing roller has large surface unevenness in the axial direction, the elastic layer undergoes no such great deformation that causes stress concentration. Thus, the sealing material of the invention eliminates the above-described disadvantages associated with conventional sealing materials, such that a fluorine resin is broken or worn out, or does not fit the roller to cause toner leakage through a gap formed.

The thickness of the tetrafluoroethylene resin porous layer must be at least 0.2 mm. With the thickness being 0.2 mm or more, the resin layer can be applied to the cylindrical parts holding the developing roller by, for example, heat shrinking without requiring any special technique to obtain a smooth curved surface having no wrinkles in contact and along with the developing roller. A preferred thickness of the resin porous layer is 0.25 mm or more. The upper limit of the thickness of the resin porous layer is not particularly limited as long as the sealing material exhibits satisfactory sealing properties and low torque upon rotation.

The tetrafluoroethylene resin porous layer preferably has a porosity of at least 40%, and more preferably from 55 to 85%. When the porous layer having a porosity of 40% or more is used, the pores are collapsed upon contact with the uneven surface of the developing roller to cause plastic deformation to thereby enhance the effect of keeping a tight contact with the roller and maintaining satisfactory sealing properties.

The tetrafluoroethylene may be imparted with the same electrostatic charging property as the toner for preventing adhesion of the toner to the sealing material, and may contain additives and may be copolymerized with other monomers for improving the production stability, etc. as long as the formation of the porous layer is not inhibited.

The method for fixing the toner sealing material of the present invention to a toner cartridge is not particularly limited, but may be such a method in that the elastic layer is firstly fixed on the cartridge and then the resin porous layer is formed thereon, and such a method in that a laminate of the elastic layer and the resin porous layer is produced and the laminate is then fixed to a cartridge.

The present invention is now illustrated in greater detail with reference to the following examples, but it should be understood that the present invention is not deemed to be limited thereto.

EXAMPLE 1

Double coated adhesive tape was adhered on a 3 mm thick polyurethane rubber sheet having a degree of foaming of 80% and a hardness of 30 as measured by Asker C type hardness meter, and a 0.3 mm thick tetrafluoroethylene resin porous sheet having a porosity of 70% was adhered thereon. The laminated sheet was cut to a prescribed shape to obtain a toner sealing material.

The resulting toner sealing material was fixed to a toner cartridge of a copying machine ("LBP-A408" produced by Canon Inc.), and running test was carried out to obtain 5,000 copies of a test chart. The copies obtained after the running test suffered from no staining on the peripheral area thereof.

COMPARATIVE EXAMPLE 1

Double coated adhesive tape was adhered on a 3 mm thick sheet made of felt, and a 0.5 mm thick tetrafluoroethylene resin porous sheet having a porosity of 70% was adhered thereon. The laminated sheet was cut to a prescribed shape to obtain a toner sealing material.

The resulting sealing material was evaluated in the same manner as in Example 1. The copies suffered from staining on the peripheral area with the toner leaked through a gap formed by a batter of the felt.

COMPARATIVE EXAMPLE 2

Double coated adhesive tape was adhered on a 3 mm thick sheet made of felt, and a sheet of fluorine-type felt having good sliding properties was adhered thereon. The resulting laminated sheet was cut to a prescribed shape to obtain a toner sealing material.

The resulting sealing material was evaluated in the same manner as in Example 1. The copies suffered from staining with the toner leaked through a gap by a batter of the felt and through fibers of felt.

COMPARATIVE EXAMPLE 3

Double coated adhesive tape was adhered on a 3 mm thick chloroprene rubber sheet, and a 0.1 mm thick tetrafluoroethylene resin porous sheet having a porosity of 70% was adhered thereon. The laminated sheet was cut to a prescribed shape to obtain a toner sealing material.

The resulting sealing material was evaluated in the same manner as in Example 1. Toner leakage occurred due to failure of the sealing material in tightly fitting the developing roller.

As described and demonstrated above, the present invention provides a sealing material which prevents a toner from leaking through developing roller bearing parts of a toner cartridge. Application of the sealing material of the present invention to electrophotographic image formation apparatus, e.g., electrophotographic copying machines, printers and facsimiles, makes it possible to obtain stain-free images for an extended period of time.

While the invention has been described in detail and with reference to specific examples thereof, it will be apparent to one skilled in the art that various changes and modifications can be made therein without departing from the spirit and scope thereof.

What is claimed is:

1. A toner sealing material for preventing toner leakage through bearing parts of a developing roller fixed to a toner cartridge which faces a photosensitive drum, said toner sealing material comprising an elastic layer which is in contact with said cartridge via an adhesive layer and a tetrafluoroethylene resin porous layer which is (1) laminated on said elastic layer via an adhesive layer in the radial direction to said developing roller, and (2) in contact with the surface of the developing roller; wherein said tetralfuoroethylene resin porous layer has a thickness of at least 0.2 mm and a porosity of at least 40%.

2. A toner sealing material as claimed in claim 1, wherein said tetrafluoroethylene resin porous layer has a thickness of at least 0.25 mm.

3. A toner sealing material as claimed in claim 1, wherein said tetrafluoroethylene resin porous layer has a porosity of from 55 to 85%.

4. A toner sealing material as claimed in claim 1, wherein said elastic layer comprises chloroprene rubber having a degree of foaming of from 60 to 85%.

* * * * *